US005925985A

United States Patent [19]

Zeng et al.

[11] Patent Number: 5,925,985

[45] Date of Patent: Jul. 20, 1999

[54] ELECTRONIC BALLAST CIRCUIT FOR IGNITING, SUPPLYING AND DIMMING A GAS DISCHARGE LAMP

[75] Inventors: Xiaoming Zeng; Kia Tong Tan; Che Lock Chia, all of Singapore, Singapore

[73] Assignee: Singapore Productivity and Standards Board, Singapore

[21] Appl. No.: 08/899,253

[22] Filed: Jul. 23, 1997

Related U.S. Application Data

[30] Foreign Application Priority Data

Jul. 27, 1996 [SG] Singapore ..... 9610367

[51] Int. Cl.[6] ..... H05B 41/02; H05B 41/38

[52] U.S. Cl. ..... 315/224; 315/307; 315/DIG. 7; 315/DIG. 4; 315/225

[58] Field of Search ..... 315/225, 219, 315/DIG. 4, 224, DIG. 7, 307

[56] References Cited

U.S. PATENT DOCUMENTS

| | | | |
|---|---|---|---|
| 4,210,846 | 7/1980 | Capewell et al. | 315/121 |
| 4,682,084 | 7/1987 | Kuhnel et al. | 315/307 |
| 4,734,828 | 3/1988 | Vargo | 315/307 |
| 4,748,383 | 5/1988 | Houkes | 315/248 |
| 4,751,398 | 6/1988 | Ertz, III | 307/66 |
| 4,887,007 | 12/1989 | Almering et al. | 315/243 |
| 4,933,606 | 6/1990 | Tary | 315/244 |
| 4,935,672 | 6/1990 | Lammers et al. | 315/200 R |
| 4,937,498 | 6/1990 | Bolhuis et al. | 315/106 |
| 4,949,016 | 8/1990 | De Bijl et al. | 315/208 |
| 4,952,842 | 8/1990 | Bolhuis et al. | 315/106 |
| 4,952,845 | 8/1990 | Veldman | 315/209 R |
| 4,965,493 | 10/1990 | Van Meurs et al. | 315/224 |
| 5,010,278 | 4/1991 | Kang | 315/224 |
| 5,027,038 | 6/1991 | De Bijl et al. | 315/209 R |
| 5,075,599 | 12/1991 | Overgoor et al. | 315/224 |
| 5,173,643 | 12/1992 | Sullivan et al. | 315/276 |
| 5,293,099 | 3/1994 | Bobel | 315/225 |
| 5,345,148 | 9/1994 | Zeng et al. | 315/209 R |
| 5,495,149 | 2/1996 | Hiramatsu et al. | 315/209 R |
| 5,541,829 | 7/1996 | Maehara et al. | 363/34 |

FOREIGN PATENT DOCUMENTS

| | | |
|---|---|---|
| 430 357 | 6/1991 | European Pat. Off. . |
| 430 358 | 6/1991 | European Pat. Off. . |
| 2472297 | 6/1981 | France . |
| 3625499 | 10/1987 | Germany . |
| 3626209 | 2/1988 | Germany . |
| 4014355 | 1/1991 | Germany . |
| 63064575 | 3/1988 | Japan . |
| 8 102 504 | 4/1981 | South Africa . |
| 603102 | 3/1978 | U.S.S.R. . |
| 750682 | 7/1980 | U.S.S.R. . |
| 2030388 | 4/1980 | United Kingdom . |
| 2072846 | 10/1981 | United Kingdom . |
| 2117192 | 2/1982 | United Kingdom . |
| 2133940 | 8/1984 | United Kingdom . |
| 2147159 | 5/1985 | United Kingdom . |
| 2224170 | 4/1990 | United Kingdom . |
| 2229870 | 10/1990 | United Kingdom . |
| WO93/25952 | 12/1993 | WIPO . |

OTHER PUBLICATIONS

*Internationl Rectifier, Self–Oscillating Half–Bridge Driver*, Data Sheet No. PD–6.029G, IR2155, pp. 130–134.

*Primary Examiner*—Arnold Kinkead

*Attorney, Agent, or Firm*—Klarquist Sparkman Campbell Leigh & Whinston LLP

[57] ABSTRACT

An electronic ballast circuit for igniting, supplying and dimming a gas discharge lamp which comprises an oscillation control circuit, an IR2155 self-oscillating half-bridge driver, a dimming control circuit, a load circuit including at least one gas discharge lamp and an over-current protection circuit, wherein the oscillation control circuit controls a current through the lamp by pulse width modulation of a drive signal during a pre-heating stage and the normal operation to control the dimming of the gas discharge lamp.

17 Claims, 1 Drawing Sheet

ELECTRONIC BALLAST CIRCUIT FOR IGNITING, SUPPLYING AND DIMMING A GAS DISCHARGE LAMP

FIELD OF THE INVENTION

THIS INVENTION relates to an electronic ballast circuit or converter for igniting and supplying a gas discharge lamp, e.g. a fluorescent lamp, the converter having two terminals intended to be connected to a d.c. voltage source, the input terminals being connected together in series by an arrangement of at least a first semiconductor switching element, a first capacitor and a load circuit comprising at least an induction coil and the gas discharge lamp in parallel with a second capacitor. The first capacitor and the load circuit are shunted by a second semiconductor switching element provided with a control circuit comprising at least a starter circuit and a resonant circuit. The resonant circuit includes the parallel arrangement of the transformer primary winding and a capacitor in one branch and the gas discharge lamp in the other branch.

BACKGROUND AND SUMMARY

A DC-AC converter of this type is known from U.S. Pat. No. 4,415,838 and U.S. Pat. No. 4,748,383. In this known converter a transformer is present in the load circuit (in which the lamp is incorporated). This transformer has two secondary windings which form part of the control circuits for the semiconductor switching elements. The switching elements are rendered alternatively conducting and non-conducting by means of the transformer and the control circuits respectively.

However, some basic short comings of the known circuit are that the circuit is started by applying a relatively large transient current to the load circuit and the resonant circuit so that the resonant circuit begins to oscillate to provide the drive signal for the semiconductor switching elements. The oscillation frequency of the resonant circuit is controlled by the load circuit. This results in a poor switch time for the semiconductor switching elements and poor soft starting for ignition of the lamp. It is also known that this circuit is unable to provide the dimming function for controlling the lamp brightness.

It is an object of the invention to overcome the above-mentioned problems by providing a circuit using an IR2155 self-oscillating half-bridge driver in which the pulse width of the drive signal for the semiconductor switching elements can be modulated during the ignition and operation of a gas discharge lamp so as to provide preheating and dimming functions for the electronic ballast, and to provide a circuit which can be used for output over-current protection.

Accordingly, an electronic ballast circuit is disclosed for igniting, supplying and dimming a gas discharge lamp which comprises an oscillation control circuit, an IR2155 self-oscillating half-bridge driver, a dimming control circuit, a load circuit including at least one gas discharge lamp and an over-current protection circuit, wherein the oscillation control circuit controls a current through the lamp via the pulse width modulation of a drive signal during a pre-heating stage and normal operation for the undimming ballast and the dimming ballast.

In a specific embodiment of the present invention, there is provided an electronic ballast circuit for igniting, supplying and dimming a gas discharge lamp comprising: first and second input terminals (A and B) for connection to a source of DC voltage; a controlled semiconductor switching element having a drain electrode, a source electrode and a control electrode; a IR2155 self-oscillating half-bridge driver having an oscillator timing resistor input RT, an oscillator timing capacitor input CT, a high side floating supply VB, a high side gate drive output HO, a high side floating supply return VS, a low side supply VCC, a low side gate drive output LO and a low side return GND; a choke transformer having a primary winding and a secondary winding; first means for connecting first (Q1) and second (Q2) semiconductor switching elements in a first series circuit across said first and second terminals; second means for connecting one end of a load circuit and one end of a snubber circuit to a junction point between said first and second semiconductor switching elements and further connecting the other end of said load circuit to said second terminal (B) and the other end of said snubber circuit to said first terminal (A); said load circuit comprising a first capacitor, a gas discharge lamp and a choke transformer; said snubber circuit having a first resistor and a second capacitor connected in series; third means for connecting the input terminals of a first DC supply circuit across said first and second terminals; said first DC supply circuit having a second resistor and a third capacitor connected in series; fourth means for connecting said VCC pin of the IR2155 self-oscillating half-bridge driver to a junction point of said second resistor and said third capacitor of said first DC supply via a first diode, and then to said second terminal via a fourth capacitor; and further connecting said GND pin of the IR2155 self-oscillating half-bridge driver to said second terminal; fifth means for connecting said VB pin of the IR2155 self-oscillating half-bridge driver to said VCC pin of the IR2155 self-oscillating half-bridge driver via a second diode, and further connecting said VS pin of the IR2155 self-oscillating half-bridge driver to a junction point between said first and second semiconductor switching elements, and then connecting a fifth capacitor across said VB pin and said VS pin of the IR2155 self-oscillating half-bridge driver; sixth means for connecting said HO pin of the IR2155 self-oscillating half-bridge driver to a control electrode of said first semiconductor switching element (Q1) via a third resistor, and further connecting said L0 pin of the IR2155 self-oscillating half-bridge driver to a control electrode of said second semiconductor switching element (Q2) via a fourth resistor; seventh means for connecting one end of a second DC supply to said VCC pin of the IR2155 self-oscillating half-bridge driver, and further connecting the other end of said second DC supply to said second terminal; said second DC supply comprising a secondary winding of said choke transformer, a third diode, a fourth diode and a fifth resistor connecting in series, and a sixth capacitor across one end of said secondary winding and a cathode of said third diode; eighth means for connecting a resistive voltage divider between said VCC pin of the IR2155 self-oscillating half-bridge driver and said second terminal; said resistive voltage divider having sixth and seventh resistors connected in series, and a seventh capacitor in parallel with said seventh resistor; nineth means for connecting a first part of an oscillation control circuit to said RT pin of the IR2155 self-oscillating half-bridge driver, and then connecting a second part of said oscillation control circuit to said CT pin of the IR2155 self-oscillating half-bridge driver, and then connecting a third part of said oscillation control circuit to said second terminal, and further connecting a fourth part of said oscillation control circuit to a junction point of said resistive voltage divider; said oscillation control circuit comprising a pulse-width limiting circuit, a pulse-width control circuit and an oscillation circuit; said pulse-width limiting circuit having an eighth resistor and a fifth diode connected in series and then connected in parallel with a ninth resistor; said pulse-width control circuit having a sixth diode, a third semiconductor switching element (Q3) and a tenth resistor connected in series and then connected to an eleventh resistor in parallel with an emitter electrode and a collector electrode of said third switching element; said oscillation circuit having a twelfth resistor and an eighth capacitor connected in series; tenth means for connecting one end of said pulse-width limiting circuit to said first part of said oscillation control circuit, and then connecting the other end of said pulse-width limiting circuit to one end of said pulse-width control circuit and one end of said oscillation circuit, and then connecting a collector electrode of said third semiconductor switching element to a junction point of said oscillation circuit and to the second part of said oscillation control circuit, and then connecting the other end of said pulse-width control circuit and the other end of said oscillation circuit together to the third part of said oscillation control circuit, and further connecting a base electrode of said third semiconductor element to the fourth part of said oscillation control circuit; eleventh means for connecting one end of a dimming control circuit to a junction point of said resistive voltage divider, and then connecting the other end of said dimming control circuit to said second terminal; said dimming control circuit comprising a thirteenth resistor and an opto-transistor OP1 connected in series, a ninth capacitor across the base electrode and emitter electrode of said opto-transistor, and a fourteen resistor connected in series with an opto-diode of said opto-transistor; twelfth means for connecting one end of a protection control circuit to a junction point of said first DC supply, and connecting the other end of said protection control circuit to said second terminal; said protection control circuit having a fifteenth resistor, a silicon controlled rectifier and a sixteenth resistor connected in series, and a tenth capacitor connected in parallel with the sixteenth resistor and a fourth semiconductor switching element (Q4) with a base electrode connected to a junction point of said sixteenth resistor and said silicon controlled rectifier, and a collector electrode connected to the base electrode of said third semiconductor switching element; thirteenth means for connecting one end of a current sensing circuit to a control electrode of said silicon controlled rectifier and other end to a junction point of said third diode and said fourth diode; said current sensing circuit comprising a seventeenth resistor, a zener diode and an eighteenth resistor connected in series, and an eleventh capacitor connected in parallel with said seventeenth resistor and a twelfth capacitor connected between a junction point of said zener diode and said eighteenth resistor.

An oscillation control circuit of the electronic ballast circuit embodying the present invention controls the pulse-width of the drive signal through the third semiconductor switching element (Q3). The off-time of drive signal is fixed through the ninth resistor and twelfth resistor and the eighth capacitor. The tenth resistor is placed in parallel with the eighth capacitor is to control the off-time near the fixed value during the starting stage. The on-time of the drive signal can be varied by the third semiconductor switching element (Q3) and the sixth diode by setting the base current of Q3 through the resistive voltage divider. The value of the sixth resistor and seventh capacitor in the resistive voltage divider determines the time for the preheating during the starting stage. The eighth resistor and the fifth diode control the minimum pulse-width of the drive signal when the third semiconductor switching element is almost fully on. The eleventh resistor across the third semiconductor switching element controls the maximum pulse-width of the drive signal when the third semiconductor switching element is almost fully off. The oscillation control circuit is able to provide the light output control of the lamp via the pulse-width modulation of the drive signal.

An embodiment of the present invention can control the light output over a wide range through the dimming control circuit comprising the opto-transistor and the control signal input terminals of said opto-transistor. The input voltage across said control signal input terminals of the opto-transistor control the base current of the opto-transistor which controls the base current of the third semiconductor switching element, and then modulates the pulse-width of the drive signal. Using opto-transistor, the dimming control circuit can easily be implemented by providing the voltage across the control signal input terminals of the opto-transistor for remote control.

An embodiment of the present invention is based on the recognition that upon switching on the ballast the third capacitor of the first DC supply circuit is first charged until the voltage on the IR2155 self-oscillating half-bridge driver is about 5 volts to provide the initial oscillation of the oscillation control circuit. As a result, the voltage divider sets the minimum pulse-width of the driver signal and the current starts to flow through the gas discharge lamp filament and heat it up. Whilst the voltage of the secondary winding of the choke transformer is being built up, the second DC supply is taken over by the first DC power supply and powers the IR2155 self-oscillating half-bridge driver and the control circuit. The supply voltage for the IR2155 self-oscillating half-bridge driver and the control circuit is gradually increased to the operating voltage of 15 volts. Meanwhile, the pulse-width of the drive signal is gradually increased up to the preset value. The lamp starts to ignite and the output power for the lamp is gradually increased to the preset level. The output power for the lamp can be set by tuning the voltage divider. The maximum output voltage of the first DC supply is set to 5 volts by tuning the resistance value of the second resistor of the first DC supply so as to reduce its power dissipation and to provide soft start and preheating functions. The preheating time can be adjusted by tuning the sixth resistor and seventh capacitor. During normal operation, the brightness of the lamp can be tuned from 0% to 100% by providing 10 volts to 0 volt to the control signal input terminals of the dimming control circuit.

According to an embodiment of the present invention, the over-current protection circuit comprises at least a silicon controlled rectifier and a zener diode connected to the secondary winding of the choke transformer that is shared with the second DC supply. The secondary winding of the choke transformer is used to supply the power for the driver circuit and control circuit and to sense the output current. When the output current increases to the maximum value and the voltage of the secondary winding across the zener diode reaches its breakdown voltage, the zener diode starts to conduct and charges up the eleventh capacitor. As soon as the voltage across the eleventh capacitor reaches a firing voltage of the silicon controlled rectifier, the silicon controlled rectifier conducts and provides the large base current to turn on the fourth semiconductor switching element. As a result, the third semiconductor switching element is fully turned on and the oscillation of the oscillation control circuit stops. The protection circuit is latched until the ballast is reset. The maximum current value of the ballast can be set by selecting the breakdown voltage of the zener diode.

The invention is particular advantageous for use in low-pressure mercury vapour discharge lamps where the heating filament is used to ignite the lamp. Lamp life is dependent upon the preheating control during ignition. An embodiment of the present invention makes it easy to control the preheating time by varying the capacitance value of the seventh capacitor. This offers an extension of the lamp life.

An advantage of one embodiment of the ballast circuit is that the lamp can dimmed by modulating the pulse-width of the drive signal for local control and remote control. The protection circuit provides an easy way to expand current protection to full protection, i.e. input over-voltage protection, by triggering the silicon controlled rectifier.

In order that the invention may be more readily understood, and so that further features thereof may be appreciated, an embodiment of the present invention will now be described with reference to the accompanying drawing which illustrates diagrammatically an embodiment of the electronic ballast circuit according to the present invention.

DETAILED DESCRIPTION

Figure 1:
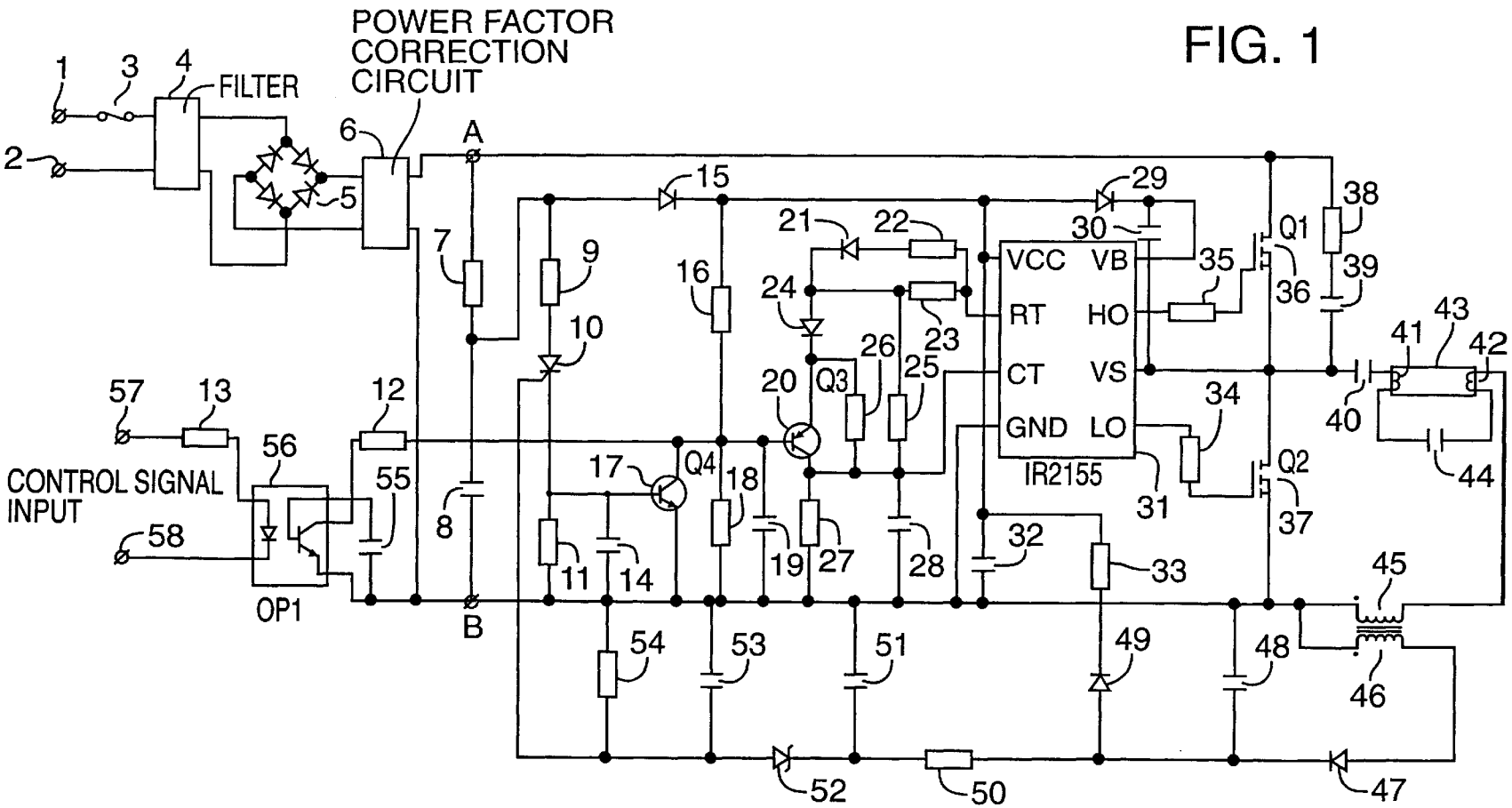
FIG. 1 is a schematic diagram illustrating an embodiment of an electronic ballast circuit.

FIG. 1 shows an electronic ballast for igniting, supplying and dimming a gas discharge lamp. The ballast circuit includes a supply circuit having two input terminals 1 and 2 intended to be connected to an alternating voltage source of 220–240 V, 50 Hz. The terminals are connected via a fuse 3 to a filter circuit 4, and then to a full wave rectifier 5. The output terminal of the full wave rectifier 5 is connected to a power factor collection circuit 6. Output terminals A and B of the power factor collection circuit supply a DC voltage to the rest of the electronic ballast circuit.

The output terminals A and B are connected together by means of a series arrangement of a first semiconductor switching element 36 and a second semiconductor switching element 37. The switching elements are power MOS-FET type transistors.

The switching elements 36 and 37 are connected together in such manner that the source electrode of the first switching element 36 is connected to the drain electrode of the second switching element 37.

A snubber circuit including a resistor 38 and a capacitor 39 is connected in parallel with the first switching element 36 to suppress any transient voltage during the switching.

The second switching element 37 is shunted by means of a series arrangement of a load circuit made up of a capacitor 40, electrodes 41,42 of a gas discharge lamp 43 (having a capacitor 44 connected across the electrodes 41,42) and a primary winding 45 of a choke transformer.

The ballast circuit has two DC supplies for the control circuit. The first DC supply includes a resistor 7, a capacitor 8, a diode 15 and a capacitor 32. The resistor 7 and the capacitor 8 are connected in series across the terminals A and B. The cathode of the diode 15 is connected to a junction point of the resistor 7 and capacitor 8, and the anode of the diode 15 is connected to a capacitor 32 that supplies the DC voltage to the control circuit. The output voltage of the first DC supply is set to a maximum of 5 volts to allow the control circuit to start the oscillation.

The second DC supply includes a secondary winding 46 of the choke transformer, a diode 47, a capacitor 48, a diode 49 and a resistor 33. The diode 47 and the capacitor 48 are connected in series across the secondary winding 46 of the choke transformer. The resistor 33 and the diode 49 are connected in series, one end of this series circuit being connected to a junction point of the capacitor 48 and the diode 47 and other end of this series circuit being connected to a junction point of the diode 15 and the capacitor 32 such that a DC voltage supply of about 15 volts is provided to the control circuit during normal operation.

The control circuit of the electronic ballast circuit includes a half-bridge driver 31 having an oscillator timing resistor input RT an oscillator timing capacitor input CT, a high side floating supply VB, a high side gate drive output HO, a high side floating supply return VS, a low side supply VCC, a low side gate drive output LO and a low side return GND, an oscillation control circuit, a dimming control circuit and an over-current protection circuit. The half-bridge driver in this embodiment is an IR2155 self-oscillating half-bridge driver manufactured by International Rectifier.

In the IR2155 driver circuit, the high side floating supply VB pin of the IR2155 is connected to the low side supply VCC pin of the IR2155 via a diode 29. A capacitor 30 is connected across the VB pin and VS pin of the IR2155. The high side floating supply return VS pin of the IR2155 is then connected to the junction point of the first switching element 36 and the second switching element 37. The high side gate drive output pin HO is connected to a gate electrode of the first switching element 36 via a resistor 35 and the low side gate drive output LO pin is connected to a gate electrode of the switching element 37 via a resistor 34. Furthermore, the low side return GND pin of IR2155 is connected to the terminal B and the low side supply VCC pin of IR2155 is connected to the output end of the first and second DC supply circuit.

The oscillation control circuit comprises a resistive voltage divider, a pulse-width limiting circuit, a pulse-width control circuit and an oscillation circuit. In the resistive voltage divider, a resistor 16 and 18 are connected in series across the DC supply for the control circuit, a capacitor 19 is connected in parallel with the resistor 18. A junction point of the resistors 16 and 18 is then connected to the base electrode of a third switching element 20 in the pulse-width control circuit to set the pulse-width of the drive signal. The time constant to charge up the capacitor 19 via the resistor 16 determines the preheating time for the lamp. In the pulse-width limiting circuit, a resistor 22 and a diode 21 are connected in series, and then in parallel with a resistor 23 to set the minimum pulse-width for the pulse-width control circuit. The pulse-width control circuit comprises a diode 24, the third switching element 20 and a capacitor 28 being connected in series to control the charging time for a capacitor 28 by changing the conductivity of the third switching element 20. A resistor 26 connected in parallel with the third switching element 20 is used to set the maximum pulse-width when the third switching element 20 is almost off. A resistor 27 connected in parallel with capacitor 28 is used to control the off-time of the drive signal during ignition and normal operation of the gas discharge lamp.

In an oscillation circuit, a resistor 25 is connected in parallel with the diode 24 and the third switching element 20 to provide the discharge pass for the capacitor 28. The one end of the pulse-width limiting circuit is connected to the RT pin of the IR2155, and the other end of the pulse-width limiting circuit is connected to a cathode of the diode 24. The CT pin of the IR2155 is connected to a junction point of the resistor 25 and the capacitor 28.

The dimming control circuit is made up of a resistor 12, an opto-transistor 56 (OP1), a capacitor 55 and a resistor 13.

The resistor 12 and output terminals of the opto-transistor 56 are connected in series, and then the base electrode of opto-transistor is connected to the capacitor 55. The control signal input terminals 57,58 across the resistor 13 and an opto diode of the opto-transistor 56 connecting in series is to control the conductivity of the opto-transistor 56. The capacitor 55 connected across the base electrode and the emitter electrode of the opto-transistor 56 is used to suppress noise during ignition and operation of the gas discharge lamp. The collector electrode of the opto-transistor 56 is then connected to the base electrode of the third switching element 20 via the resistor 12 to control the pulse-width of the drive signal by changing the base current of the third switching element 20. The base current of the third switching element 20 can be varied by changing the conductivity of the opto-transistor 56, that controls the charging time of the capacitor 28 to provide pulse-width modulation for the drive signal, thereby controlling the light output of the lamp. The resistor 12 is used to set the minimum brightness of the lamp and, together with the resistor 13, to provide almost linear modulation of the lamp brightness by the input voltage from the control signal input terminals 57,58.

The over-current protection circuit comprises a latch circuit and a current sensing circuit. The latch circuit have a resistor 9, a silicon controlled rectifier 10 and a resistor 11 connected in series across the capacitor 8. The anode of the silicon controlled rectifier 10 is then connected to the base electrode of a fourth switching element 17 in order to latch the fourth switching element 17 in the fully on stage by providing a trigger signal to the control electrode of the silicon controlled rectifier. The current sensing circuit comprises a capacitor 51, a capacitor 53, a resistor 54 and a series circuit with the secondary winding 46 of the choke transformer, the diode 47, a resistor 50, a zener diode 52 connected in series. The one end of this series circuit is connected to the terminal B, and the other end of this series circuit is connected to the control electrode of the silicon controlled rectifier 10 to provide an over-current signal to the latch circuit. The resistor 54 is connected between the control electrode of the silicon controlled rectifier and the terminal B is used to protect the silicon controlled rectifier from over-voltage damage. The capacitor 54 connected across the resistor 54 is used to suppress the noise during ignition and operation of the gas discharge lamp. The capacitor 51 connected between the anode of the zener diode 52 and the terminal B is used to provide the delay time for the protection circuit and to suppress the starting transient for the protection circuit. The maximum current value is set by selecting the breakdown voltage of the zener diode 52. When the voltage of the secondary winding exceeds the breakdown voltage of the zener diode 52, the zener diode 52 becomes conducting to provide an over-current signal to the latch circuit. The over-current signal then triggers the silicon controlled rectifier 10 and turns on the fourth switching element 17 and the third switching element 20 to stop the oscillation of the oscillation control circuit.

During ignition of the gas discharge lamp, the high voltage present across the terminals A and B charges up the capacitor 8 of the first DC supply circuit via the resistor 7. When the voltage across the capacitor 8 reaches about 5 volts, the IR2155 self-oscillating half-bridge driver 31 starts to operate and the resistive voltage divider sets the minimum base current to the third switching element 20. As a result, the oscillation control circuit oscillates with the minimum pulse-width, and the first switching element 36 and the second switching element 37 are rendered alternatively conducting and non-conducting to provide high frequency AC power to the load circuit. Meanwhile the lower current through the filament electrodes 41,42 of the lamp 43 preheats the lamp 43, and then through the primary winding 45 of the choke transformer provides the voltage across the secondary winding of the choke transformer which charges up the capacitor 48 of the second DC supply circuit. When the output voltage of the second DC supply exceeds 5 volts, the second DC supply takes over the first DC supply to supply the power for the control circuit. The DC voltage for the control circuit then starts to increase gradually to 15 volts. Meanwhile, the pulse-width of the drive signal is gradually increased to a maximum value by gradually increasing the base current of the third switching element via the resistive voltage divider. As a result, the current through the filament electrodes 41,42 of the lamp 43 is increased, the lamp is ignited at the very low current and the brightness of the lamp is gradually increased from 0% to 100%. The preheating time is dependent on the time constant of the resistor 16 and the capacitor 19. This circuit arrangement provides a soft start for the ballast and provides a way of controlling the preheating time before ignition.

During normal operation, the brightness of the lamp is controlled by the input voltage from the control signal input terminals 57,58, the brightness of the lamp increasing by decreasing the voltage across the control signal input terminals 57,58. The maximum brightness is determined by the resistive value of the voltage divider. If there is no voltage across the control signal input terminals 57,58, then the circuit becomes an undimming ballast providing maximum brightness output. This means that the undimming ballast and the dimming ballast can be built on the same circuit board at almost no additional cost.

Having thus described an embodiment of the invention, it will now be appreciated that the objects of the invention have been fully achieved, and it will be understood by those skilled in the art that many changes in construction and widely differing embodiments and applications of the invention will suggest themselves without departing from the spirit and the scope of the invention. The disclosure and description herein are purely illustrative and are not intended to be in any sense limiting.

The Table below gives exemplary values for the respective components of the ballast circuit shown in the FIGURE:

TABLE

| Name of components | Component value or part number |
|---|---|
| Capacitor 8 | 47 μF |
| Capacitor 14 | 4.7 μF |
| Capacitor 19 | 3.3 μF |
| Capacitor 28 | 680 pF |
| Capacitor 30 | 0.1 μF |
| Capacitor 32 | 0.47 μF |
| Capacitor 39 | 1000 pF |
| Capacitor 40 | 0.22 μF |
| Capacitor 44 | 2 nF |
| Capacitor 48 | 47 μF |
| Capacitor 51 | 10 μF |
| Capacitor 53 | 4.7 μF |
| Capacitor 55 | 1000 pF |
| Coil 45 | 1.3 mH |
| Coil 46 | 13.7 μH |
| Diode 15, 24 ,21, 49 | 1N4148 |
| Diode 29 | UF4004 |
| Diode 47 | 1N4002 |
| IC chip 31 | 1R2155 |
| Photo transistor 56 | 4N26 |
| Resistor 7 | 120 KOhm |
| Resistor 9 | 1 KOhm |

TABLE-continued

| Name of components | Component value or part number |
|---|---|
| Resistor 11 | 2.2 KOhm |
| Resistor 12 | 180 KOhm |
| Resistor 13 | 47 KOhm |
| Resistor 16 | 48.7 KOhm |
| Resistor 18 | 301 KOhm |
| Resistor 22 | 1.5 KOhm |
| Resistor 23 | 4.7 KOhm |
| Resistor 25 | 56 KOhm |
| Resistor 26 | 56 KOhm |
| Resistor 27 | 45.3 KOhm |
| Resistor 33 | 3.3 KOhm |
| Resistor 34 | 100 KOhm |
| Resistor 35 | 100 KOhm |
| Resistor 38 | 10 Ohm |
| Resistor 50 | 68 KOhm |
| Resistor 54 | 6.8 KOhm |
| SRC 10 | MCR100-3 |
| Transistor 17 (04) | 2N3904 |
| Transistor 20 (03) | BC327 |
| Transistor 36, 37 (01, 02) | IRF830 |
| Zener diode | 1N9728 |

We claim:

1. An electronic ballast circuit for igniting, supplying and dimming a gas discharge lamp, the circuit comprising:

an oscillation control circuit, a self-oscillating half-bridge driver, a dimming control circuit, a load circuit including at least one gas discharge lamp and an over-current protection circuit, wherein the oscillation control circuit controls a current through the lamp by pulse width modulation of a drive signal during a preheating stage and normal operation to control the dimming of the gas discharge lamp;

wherein said circuit comprises: first and second input terminals (A and B) for connection to a source of DC voltage; a controlled semiconductor switching element having a drain electrode, a source electrode and a control electrode; a IR2155 self-oscillating half-bridge driver having an oscillator timing resistor input RT, an oscillator timing capacitor input CT, a high side floating supply VB, a high side gate drive output HO, a high side floating supply return VS, a low side supply VCC, a low side gate drive output LO and a low side return GND; a choke transformer having a primary winding and a secondary winding; first means for connecting first and second semiconductor switching elements in a first series circuit across said first and second terminals; second means for connecting one end of the load circuit and one end of a snubber circuit to a junction point between said first and second semiconductor switching elements and further connecting the other end of said load circuit to said second terminal (B) and the other end of said snubber circuit to said first terminal (A); said load circuit comprising a first capacitor, the gas discharge lamp and a choke transformer; said snubber circuit having a first resistor and a second capacitor connected in series; third means for connecting the input terminals of a first DC supply circuit across said first and second terminals; said first DC supply circuit having a second resistor and a third capacitor connected in series; fourth means for connecting said VCC pin of the IR2155 self-oscillating half-bridge driver to a junction point of said second resistor and said third capacitor of said first DC supply via a first diode, and then to said second terminal via a fourth capacitor; and further connecting said GND pin of the IR2155 self-oscillating half-bridge driver to said second terminal; fifth means for connecting said VB pin of IR2155 to said VCC pin of the IR2155 self-oscillating halfbridge driver via a second diode, and further connecting said VS pin of the IR2155 self-oscillating half-bridge driver to a junction point between said first and second semiconductor switching elements, and then connecting a fifth capacitor across said VB pin and said VS pin of the IR2155 self-oscillating half-bridge driver; sixth means for connecting said HO pin of IR2155 to a control electrode of said first semiconductor switching element via a third resistor, and further connecting said LO pin of the IR2155 self-oscillating half-bridge driver to a control electrode of said second semiconductor switching element via a fourth resistor; seventh means for connecting one end of a second DC supply to said VCC pin of the IR2155 self-oscillating half-bridge driver, and further connecting the other end of said second DC supply to said second terminal; said second DC supply comprising a secondary winding of said choke transformer, a third diode, a fourth diode and a fifth resistor connecting in series, and a sixth capacitor between one end of said secondary winding and a cathode of said third diode; eighth means for connecting a resistive voltage divider between said VCC pin of the IR2155 self oscillating half-bridge driver and said second terminal; said resistive voltage divider having sixth and seventh resistors connected in series, and a seventh capacitor in parallel with said seventh resistor; ninth means for connecting a first part of the oscillation control circuit to said RT pin of the IR2155 self-oscillating half-bridge driver, and then connecting a second part of said oscillation control circuit to said CT pin of the IR2155 self-oscillating half-bridge driver, and then connecting a third part of said oscillation control circuit to said second terminal, and further connecting a fourth part of said, oscillation control circuit to a junction point of said resistive voltage divider; said oscillation control circuit comprising a pulse-width limiting circuit, a pulse width control circuit and an oscillation circuit; said pulse-width limiting circuit having an eighth resistor and a fifth diode connected in series and then connected in parallel with a ninth resistor; said pulse width control circuit having a sixth diode, a third semiconductor switching element and a tenth resistor connected in series and then connected to an eleventh resistor in parallel with an emitter electrode and a collector electrode of said third switching element; said oscillation circuit having a twelfth resistor and an eighth capacitor connected in series; tenth means for connecting one end of said pulse width limiting circuit to said first part of said oscillation control circuit, and then connecting the other end of said pulse-width limiting circuit to one end of said pulse-width control circuit and one end of said oscillation circuit, and then connecting a collector electrode of said third semiconductor switching element to a junction point of said oscillation circuit and to the second part of said oscillation control circuit, and then connecting the other end of said pulse width control circuit and the other end of said oscillation circuit together to the third part of said oscillation control circuit, and further connecting a base electrode of said third semiconductor element to the fourth part of said oscillation control circuit; eleventh means for connecting one end of the dimming control circuit to a junction point of said resistive voltage divider, and then connecting the other end of said dimming control circuit to said second terminal; said dimming control circuit comprising a thirteenth resistor and an optotransistor connected in series, a ninth capacitor across the base electrode and emitter electrode of said optotransistor, and a fourteenth resistor connected in series with an opto-diode of said optotransistor; twelfth means for connecting one end of the protection circuit to a junction point of said first DC supply, and connecting the other end of said protection circuit to said second terminal; said protection circuit having a fifteenth resistor, a silicon controlled rectifier and a sixteenth resistor connected in series, and a tenth capacitor connected in parallel with the sixteenth resistor and a fourth semiconductor switching element with a base electrode connected to a junction point of said sixteenth resistor and said silicon controlled rectifier, and a collector electrode connected to the base electrode of said third semiconductor switching element; thirteenth means for connecting one end of a current sensing circuit to a control electrode of said silicon controlled rectifier and other end to a junction point of said third diode and said fourth diode; said current sensing circuit comprising a seventeenth resistor, a zener diode and an eighteenth resistor connected in series, and an eleventh capacitor connected parallel with said seventeenth resistor and a twelfth capacitor connected between a junction point of said zener diode and said eighteenth resistor.

2. An electronic ballast circuit according to claim 1, wherein the oscillation control circuit of the electronic ballast circuit controls the pulse-width of the drive signal through the third semiconductor switching element.

3. An electronic ballast circuit according to claim 1, wherein the off-time of the drive signal is fixed by the ninth resistor and twelfth resistor and the eighth capacitor.

4. An electronic ballast circuit according to claim 1, wherein the tenth resistor is placed in parallel with the eighth capacitor to control the off-time to near a fixed value during a starting stage.

5. An electronic ballast circuit according to claim 1, wherein the on-time of the drive signal can be varied by the third semiconductor switching element and the sixth diode by setting the base current of the third semiconductor switching element through the resistive voltage divider.

6. An electronic ballast circuit according to claim 1, wherein the value of the sixth resistor and seventh capacitor in the resistive voltage divider determines the preheating time during a starting stage.

7. An electronic ballast circuit according to claim 1, wherein the eighth resistor and the fifth diode control the minimum pulse-width of the drive signal when the third semiconductor switching element is almost fully on.

8. An electronic ballast circuit according to claim 1, wherein the eleventh resistor across the third semiconductor switching element controls the maximum pulse-width of the drive signal when the third semiconductor switching element is almost fully off.

9. An electronic ballast circuit according to claim 1, wherein the dimming control circuit can control a wide range of light output, the dimming control circuit comprising an opto-transistor and the control signal input terminals of said opto-transistor.

10. An electronic ballast circuit according to claim 9, wherein the input voltage across said control signal input terminals of the opto-transistor control the base current of the opto-transistor which controls the base current of the third semiconductor switching element, and then modulates the pulse-width of the drive signal.

11. An electronic ballast circuit according to claim 9, wherein the dimming control circuit can be implemented by providing the voltage across the control signal input terminals of the opto-transistor by remote control.

12. An electronic ballast circuit according to claim 1, wherein the over-current protection circuit comprises at least a silicon controlled rectifier and a zener diode is connected to the secondary winding of the choke transformer that is shared with the second DC supply.

13. An electronic ballast circuit according to claim 12, wherein the secondary winding of the choke transformer is used to supply the power for the half-bridge driver and control circuit and to sense the output current.

14. An electronic ballast circuit according to claim 13, wherein when the output current increases to a maximum value and the voltage of the secondary winding across the zener diode reaches its breakdown voltage, the zener diode starts to conduct and charges up the eleventh capacitor and when the voltage across the eleventh capacitor reaches a firing voltage of the silicon controlled rectifier, the silicon controlled rectifier conducts and provides a large base current to turn on the fourth semiconductor switching element thus fully turning on the third semiconductor switching element and stopping the oscillation of the oscillation control circuit.

15. An electronic ballast circuit according to claim 14, wherein the protection circuit is latched until the ballast is reset.

16. An electronic ballast circuit according to claim 14, wherein the maximum current value of the ballast can be set by selecting the breakdown voltage of the zener diode.

17. An electronic ballast circuit according to claim 1 wherein the at least one gas discharge lamp comprises a low-pressure mercury vapour discharge lamp.

* * * * *